US006434906B1

(12) United States Patent
Jernstrom

(10) Patent No.: US 6,434,906 B1
(45) Date of Patent: Aug. 20, 2002

(54) POLE

(75) Inventor: Rolf Jernstrom, Ekenas (FI)

(73) Assignee: Jerol Industri AB, Gimo (SE)

( * ) Notice: Subject to any disclaimer, the term of this patent is extended or adjusted under 35 U.S.C. 154(b) by 0 days.

(21) Appl. No.: 09/508,131

(22) PCT Filed: Sep. 8, 1998

(86) PCT No.: PCT/FI98/00697

§ 371 (c)(1),
(2), (4) Date: Mar. 7, 2000

(87) PCT Pub. No.: WO99/13162

PCT Pub. Date: Mar. 18, 1999

(30) Foreign Application Priority Data

Sep. 8, 1997 (FI) ..... 973627
Dec. 19, 1997 (FI) ..... 974586
Feb. 2, 1998 (FI) ..... 980050 U

(51) Int. Cl.[7] ..... E04C 3/30

(52) U.S. Cl. ..... 52/726.4; 52/731.1; 52/731.4; 52/732.3; 52/736.1; 52/737.4; 428/36.5; 428/36.91

(58) Field of Search ..... 52/736.1, 736.3, 52/736.4, 737.4, 737.5, 738.1, 726.3, 726.4, 731.2, 731.4, 732.1, 732.3; 428/35.7, 36.5, 36.9, 36.91

(56) References Cited

U.S. PATENT DOCUMENTS

| | | | | |
|---|---|---|---|---|
| 3,429,758 A | | 2/1969 | Young | |
| 3,574,104 A | | 4/1971 | Medler | |
| 3,813,098 A | * | 5/1974 | Fischer et al. | 273/72 R |
| 3,813,837 A | * | 6/1974 | McClain et al. | 52/309 |
| 3,896,858 A | | 7/1975 | Whatley | |
| 4,172,175 A | | 10/1979 | Pearson et al. | |
| 4,312,162 A | * | 1/1982 | Medney | 52/309.16 |
| 4,751,804 A | * | 6/1988 | Cazaly | 52/722 |
| 4,939,037 A | * | 7/1990 | Zion et al. | 428/36.3 |
| 5,245,813 A | | 9/1993 | Brotz | |
| 5,339,594 A | * | 8/1994 | Ventura-Berti | 52/727 |
| 5,513,477 A | * | 5/1996 | Farber | 52/726.4 |
| 5,556,673 A | * | 9/1996 | Giraud | 428/34.4 |
| 6,129,962 A | * | 10/2000 | Quigley et al. | 428/36.1 |

FOREIGN PATENT DOCUMENTS

GB 1 394 084 5/1975

* cited by examiner

*Primary Examiner*—Carl D. Friedman
*Assistant Examiner*—Yvonne M. Horton
(74) *Attorney, Agent, or Firm*—Skinner and Associates

(57) ABSTRACT

The invention relates to a post (1), which is especially a hollow, tube-like piece and which is particularly intended for use as posts for traffic lights, street lights, signposts or similar, and which is formed of two layers. The inner layer (3) is of fibre-reinforced thermoset plastic and the outer layer (4) is of polyolefin plastic.

5 Claims, 1 Drawing Sheet

POLE

The present invention relates to a post, especially, but not exclusively, a post that can be used, for example, in traffic signs, streetlights, traffic lights and various signposts. Conventional power and telephone posts are naturally one large group forming an application.

Posts for such purposes are manufactured from many different materials and are generally hollow for many reasons, such as saving material. Various kinds of metal post appear to be the most commonly used. Other alternatives include posts made from reinforced and other plastics. Wooden posts are also in general use.

In certain circumstances, the weight of the post is a significant factor. Thus, the weight of metal and solid wooden posts is many times that necessary in the intended application. For example, reinforced plastic has been used in an attempt to reduce the weight problem. However, such posts have their own weaknesses, one example of which is shattering during a collision.

This invention is intended to create a post, which eliminates some of the above detriments of posts according to the state of the art to achieve a light and durable post for very many different applications.

The above and other benefits and advantages of this invention are achieved in the manner described as characteristic in the accompanying claims.

The invention is next described by reference to the accompanying diagrammatic drawings, which illustrate some embodiments of the invention.

Figure 1:
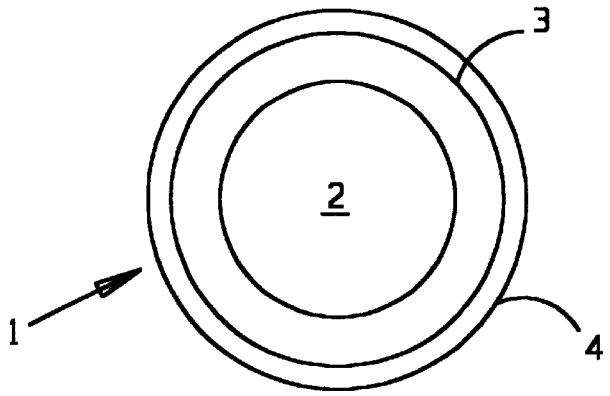
Figure 2:
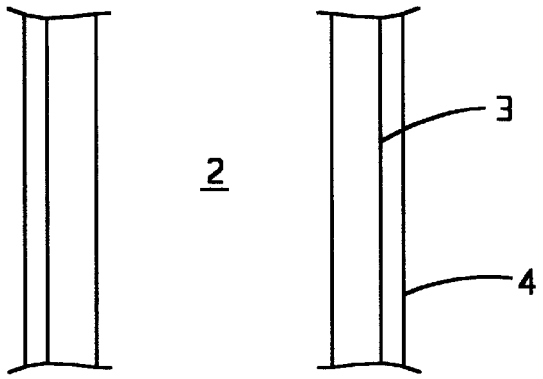
Figure 3:
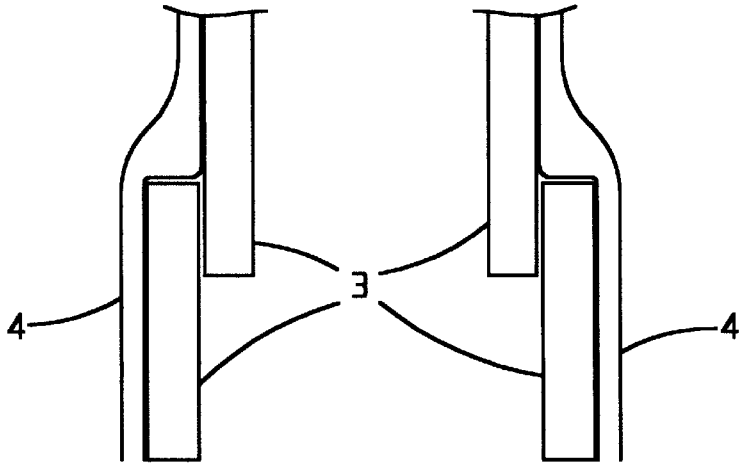

Thus:

FIG. 1 shows a cross-section of one embodiment of a post according to the invention, and FIG. 2 shows a longitudinal section of the construction according to FIG. 1, and FIG. 3 shows a partial cross-section according to FIG. 2 of another embodiment.

Thus, FIG. 1 shows a non-scale diagram of the cross-section of a post 1 according to the invention. The post is specifically hollow, and so contains a longitudinal hollow core 2. The basic construction of the post is double, with an inner layer 3 and an outer layer 4. The thicknesses of these layers 3 and 4 may differ completely from to those shown in the figure.

According to the invention, layer 3 is of fibre-reinforced thermoset plastic and the outer layer 4 is of polyolefin plastic, for example, polyethylene. This kind of construction creates quite a light total structure, which, in addition to the strength given by the inner layer also has the property of a well protected construction, because the outer layer 4 forms a tight, protective layer-on top of the inner layer. In a collision, for example, the protective layer protects against damage arising from the shattering of the inner layer, by preventing the shattered material from spreading into the environment with great force.

FIGS. 2 and 3 show two longitudinal sections with a construction according to the invention. In both constructions, polyolefin plastic is used as the outer layer 4, the inner layer being of fibre-reinforced thermoset plastic. In the embodiment in FIG. 2, the inner tube has a uniform tubular structure, while in FIG. 3, the construction is made of parts, as described later in greater detail. In both alternatives, the tube or tubes may be of uniform thickness or may especially narrow conically.

Thus, FIG. 3 shows another embodiment, in which the inner tubular component is assembled from separate tubular part with two or more different diameters, which fit inside each other to form a post construction that narrows in steps. A unified polyolefin plastic layer 4 also covers the shoulders that are formed, for example, in the manner shown at the right-hand side of FIG. 3, or more probably, as shown on the left-hand side of FIG. 3, i.e. covering the shoulders very tightly.

It is obvious that the layers are drawn separately from each other only for clarity of illustration, as in reality layers 3 and 4 form a solid entity.

It is obvious that many different compositions of thermoset plastic may be used in the manufacture of the inner layer and also that many different kinds of reinforcing fibres may be used, Glass-fibre is the traditional fibre material, but nowadays there are also other very strong fibre materials on the market, such as Keviar fibre and carbon fibre. From the point of view of the basic idea of the invention, it is clear that both the plastic materials and the fibre materials may be selected according to the intended application.

If necessary, a suitable glue-like or otherwise adhesive substance can be applied between the layers of a post construction according to the invention, which will particularly be added between the layers, for example, during the same stage when the outer layer is extruded on top of the inner layer. The outer surface of the inner layer can also be manufactured in a manner than improves adhesion, such as, for instance, roughening it or using finely crushed material from damaged posts.

All in all, a prefabricated post according to the invention will achieve an extremely useful and durable, but nevertheless light post and thus gain significant advantages over the posts in use at present. It has also properties that significantly increase its traffic safety.

What is claimed is:

1. A post for use with traffic lights, street lights, sign posts and the like, comprising a hollow, tube-like piece which is formed of two layers, wherein an inner layer is constructed of fibrereinforced thermoset plastic and an outer layer is constructed of polyolefin plastic, and wherein an adhesive material is disposed between the inner and outer layers.

2. A post according to claim 1, characterized in that the inner layer contains a material selected from the group consisting of glass fibres, kevlar fibres, carbon fibres and similar materials and the outer layer contains polyethylene.

3. A post according to claim 1, characterized in that the outer layer is a unified and continuous layer.

4. A post according to claim 1, characterized in that an outer surface of the inner layer is rough, whereby grip between the inner layer and the outer layer is improved.

5. A light weight, shatter resistant post for use with traffic lights, street lights, sign posts and the like, comprising a hollow, tube-like piece with a hollow core, said piece being formed of:

a. an inner strength layer constructed of fibre reinforced thermoset plastic including fibers selected from the group of material consisting of glass, KEVLAR and carbon, said inner layer having a thickness consisting of approximately 70 percent of the thickness of the piece, said inner layer having a rough outer surface;

c. an adhesive disposed on said outer surface of said inner layer; and b. an outer protective layer constructed of polyethylene, said outer layer having a thickness comprising approximately 30 percent of the thickness of the piece, whereby said outer protective layer minimizes spread of material shattering from the inner layer upon impact of the post by a vehicle.

* * * * *